US007204092B2

(12) United States Patent
Azcárate Castrellón et al.

(10) Patent No.: US 7,204,092 B2
(45) Date of Patent: Apr. 17, 2007

(54) ICE CUBE MAKING DEVICE FOR REFRIGERATORS

(75) Inventors: Martha Alejandra Azcárate Castrellón, Querétaro (MX); José Carlos Trejo Olvera, Querétaro (MX); Jorge Alberto Alfaro Luna, Querétaro (MX); Claudia Evelia Moysen Romero, Querétaro (MX)

(73) Assignee: Mabe Mexico S.de R.L de C.V., Queretaro Qro (MX)

( * ) Notice: Subject to any disclaimer, the term of this patent is extended or adjusted under 35 U.S.C. 154(b) by 133 days.

(21) Appl. No.: 11/098,035

(22) Filed: Apr. 1, 2005

(65) Prior Publication Data

US 2005/0241329 A1 Nov. 3, 2005

(30) Foreign Application Priority Data

Apr. 7, 2004 (MX) ..... PA/a/2004/003411

(51) Int. Cl.
*F25C 5/06* (2006.01)

(52) U.S. Cl. ..... 62/72; 62/353; 249/118; 249/120; 249/137

(58) Field of Classification Search ..... 62/66, 62/72, 340, 353, 356; 249/118, 119; 240/120, 240/137

See application file for complete search history.

(56) References Cited

U.S. PATENT DOCUMENTS 2,429,882 A * 10/1947 Jennings et al. ..... 62/344
3,621,668 A 11/1971 Swerbinsky
3,635,043 A 1/1972 Sterling
3,929,256 A * 12/1975 Solomon ..... 221/81
4,006,605 A 2/1977 Dickson et al.
4,306,423 A 12/1981 Webb et al.
4,366,941 A * 1/1983 Harris ..... 249/120
4,555,049 A 11/1985 Mawby et al.
4,852,359 A 8/1989 Manzotti
5,012,655 A * 5/1991 Chatterton ..... 62/340
5,806,333 A * 9/1998 Kim et al. ..... 62/353
5,809,797 A 9/1998 Ryu
5,829,266 A 11/1998 Lyu
5,970,725 A 10/1999 Lee
6,058,720 A 5/2000 Ryu
6,161,390 A 12/2000 Kim
6,286,324 B1 9/2001 Pastryk et al.
6,351,955 B1 * 3/2002 Oltman et al. ..... 62/71
6,474,094 B2 11/2002 Kim
6,481,235 B2 11/2002 Kwon
6,488,463 B1 12/2002 Harris
7,010,934 B2 * 3/2006 Choi et al. ..... 62/353

FOREIGN PATENT DOCUMENTS

EP 0911592 4/1999
GB 1441520 7/1976
JP 9310946 12/1997

* cited by examiner

*Primary Examiner*—William E. Tapolcai
(74) *Attorney, Agent, or Firm*—Enrique J. Mora

(57) ABSTRACT

An ice-cube making device for use in a refrigerated cabinet is provided. The ice-cube making device is attachable to a freezer liner and thus makes efficient use of the space in the freezer cavity. The ice-cube making device includes a mechanism for extracting ice by applying a twisting torque to one or more ice-cube trays therein. The ice-cube making device may also include mechanisms for refilling the ice trays with water and for providing a user-friendly installation. Aspects of the present invention may be performed either manually or may be automated.

29 Claims, 15 Drawing Sheets

ICE CUBE MAKING DEVICE FOR REFRIGERATORS

BACKGROUND OF THE INVENTION

The present invention is generally related to refrigerated appliances, and, more particularly, to an ice cube making and dispensing device for a refrigerator.

Refrigerated appliances, such as refrigerators and freezers are generally provided with devices to hold liquid water that is converted into ice. Examples of such devices include custom-made trays or molds. For the purpose of extracting the ice cubes from the trays or molds, one technique commonly used is to take the ice cube tray out from the freezer, wet the ice cubes with water at room temperature so that the ice cubes may loosen up and be released when manually bending the tray by its ends. One may then take the trays or molds to be emptied, cleaned or refilled.

The trays are generally placed either in a corner or placed inside the freezer compartment of a domestic refrigerator, or between the de-icing tray located beneath the freezer compartment and the freezer itself. In other cases, the trays are simply placed randomly inside the freezer. Often, these devices suffer drawbacks, such as poor utilization of valuable space inside the freezer compartment, the complexity of mechanisms required for ice making and expulsion, and the lack of a user-friendly and aesthetically-pleasing design. Accordingly, there is a need for addressing the foregoing drawbacks.

DETAILED SPECIFICATION OF THE INVENTION

Figure 1:
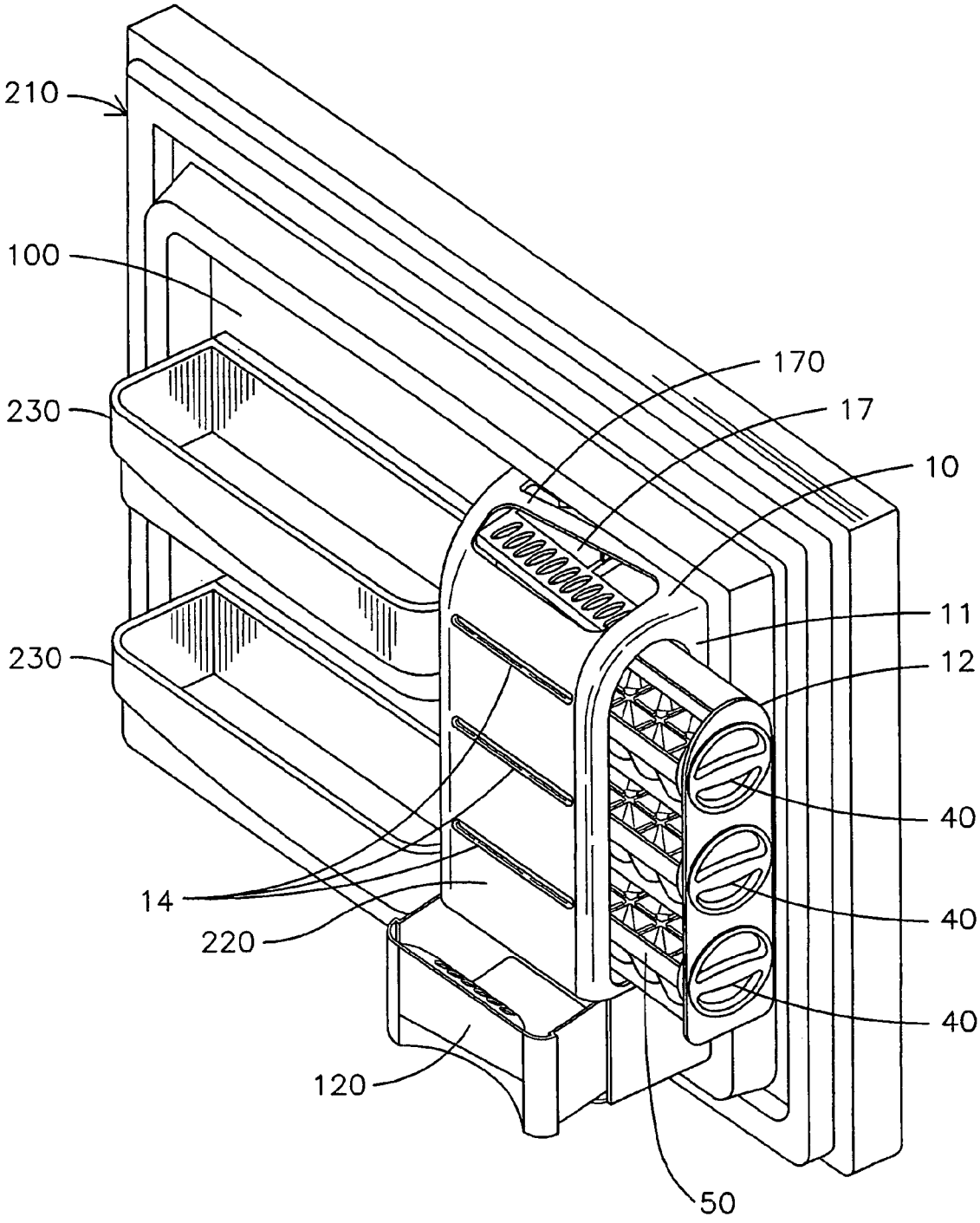
FIG. 1 is an isometric view of part of a refrigerated cabinet including an ice-cube making device embodying aspects of the present invention.

FIG. 1 illustrates an exemplary ice-cube making device 220 embodying aspects of the present invention. It will be understood that the term ice-cube making device as used herein is not limited to cube-shaped ice objects since such ice objects may be molded in any desired configuration. It will be further understood that such expression should be broadly construed since the ice-making device as described in greater detail below includes an ice-cube dispensing mechanism, and, consequently, the expression ice-cube making device may be construed as an abbreviation for the expression "ice-cube making/dispensing device". Ice-cube making device 220 may be installed at a freezer door 210 of a refrigerated cabinet.

FIG. 1 further shows a case 10, which, for example, may be made of a thermoplastic material or any suitable polymer material. Examples of polymer material may be polyethylene, polypropylene, polystyrene, polyurethane, acrylic resin, and any other equivalent material. The case may be translucid. This allows a user to view the interior of the case. It will be appreciated, however, that case 10 need not be translucid since an opaque case will also effectively fulfill aspects of the present invention. The case has at the top at least one window 17 allowing flow of cold air through the case 10. The cold air may be delivered from a chilled air chamber that houses an evaporator, as is typically provided in a standard refrigerated cabinet. At least some of the cold air from the air chamber, which usually flows through the freezer compartment and eventually into a fresh food compartment, may flow into window 17 of case 10, and over one or more ice-cube trays 50 housed inside case 10. The chilled air may flow in response to blade rotation of a suitable electric blower or fan using techniques well-understood in the art of refrigerated appliances.

The incoming air flow may follow a generally downwards path until it reaches an ice-cube collecting drawer 120 located below the ice-cube trays 50. The drawer 120 may be provided with at least one venting opening from which the air flow exits the ice-cube making device 220. It will be appreciated that such cold air flow may be helpful for reducing the ice-cube making time but is not necessary to turn the water into ice. Drawer 120 is located at the bottom of case 10 and may be removable. As described in greater detail below, drawer 120 collects ice cubes that may be released from the ice-cube trays 50.

Case 10 is provided on one side with a side opening 11 which receives a magazine 12 (shown in FIG. 1 as not fully inserted into case 10). The magazine holds ice-cube trays 50 and is provided with one or more ice-cube extraction knobs 40 on one side, which upon being turned in a certain direction (e.g., clockwise) to a certain angle cause a torsional force (e.g., a twisting torque) to be applied to a respective ice-cube tray 50, which in turn causes ice cube removal from the ice-cube tray due to a momentary mechanical distortion (e.g., twisting) imparted to the tray. To enhance the twisting effect, the torque may be distributed by means of suitably positioned limits at or near diagonally opposite corners of the tray.

By means of ramps, such as in the form of vanes 21 (FIG. 4), the ice cubes are directed to an ice-cube passage to eventually reach the collecting drawer 120. Case 10 may be optionally provided with a series of air inlet slits 14 which may allow for even a faster cooling of the ice-cube trays 50, and thereby making ice cubes in a shorter period of time due to an incremental flow of chilled air over the trays when combined with the main air stream coming from case top window 17. Proximate to the ice-cube making device 220 there may be multi-purpose shelves 230, also attachable to the liner 100.

Figure 2:
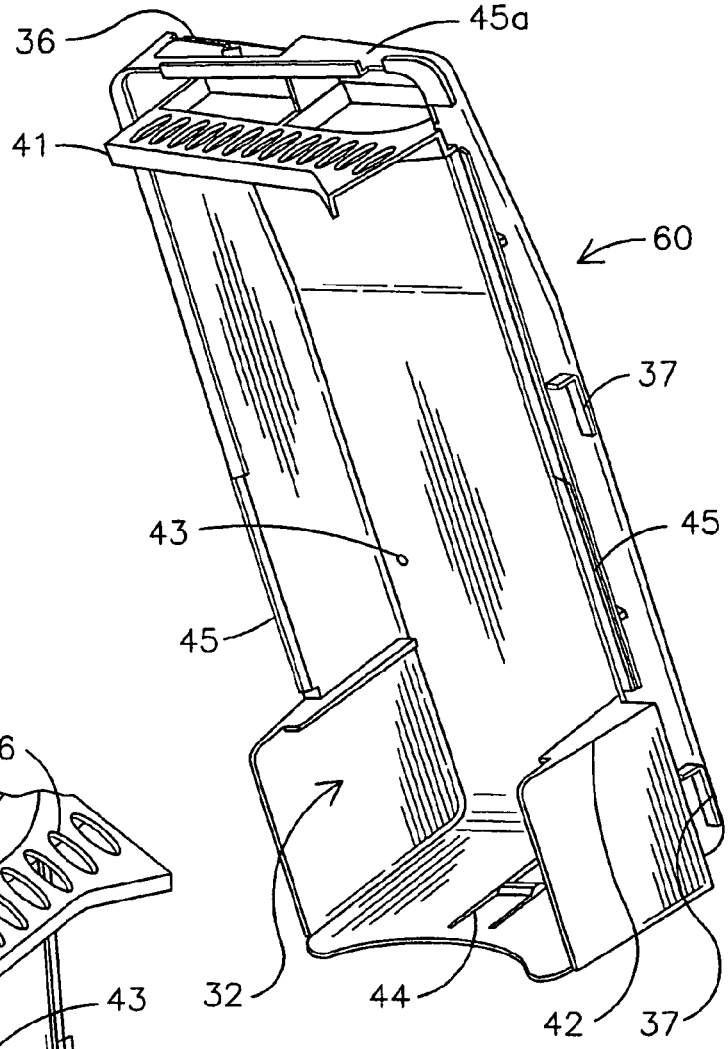
FIG. 2 is an isometric view of an exemplary support rack for the ice-cube making device of FIG. 1.
Figure 14A:
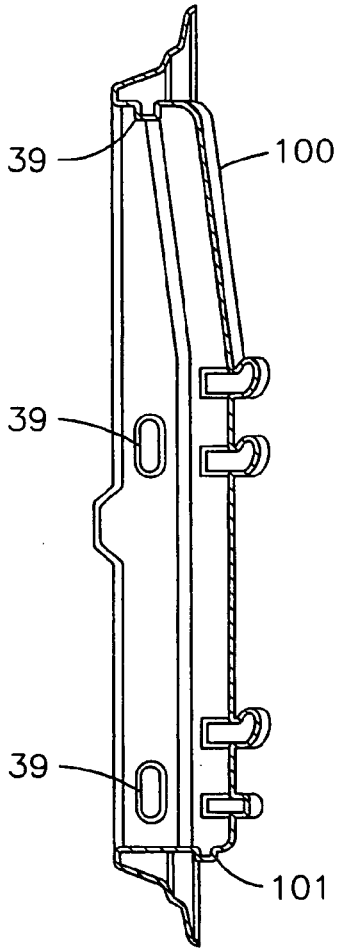
FIG. 14*a* is a cross-sectional view of the liner of FIG. 14 along the section line illustrated therein.
Figure 14:
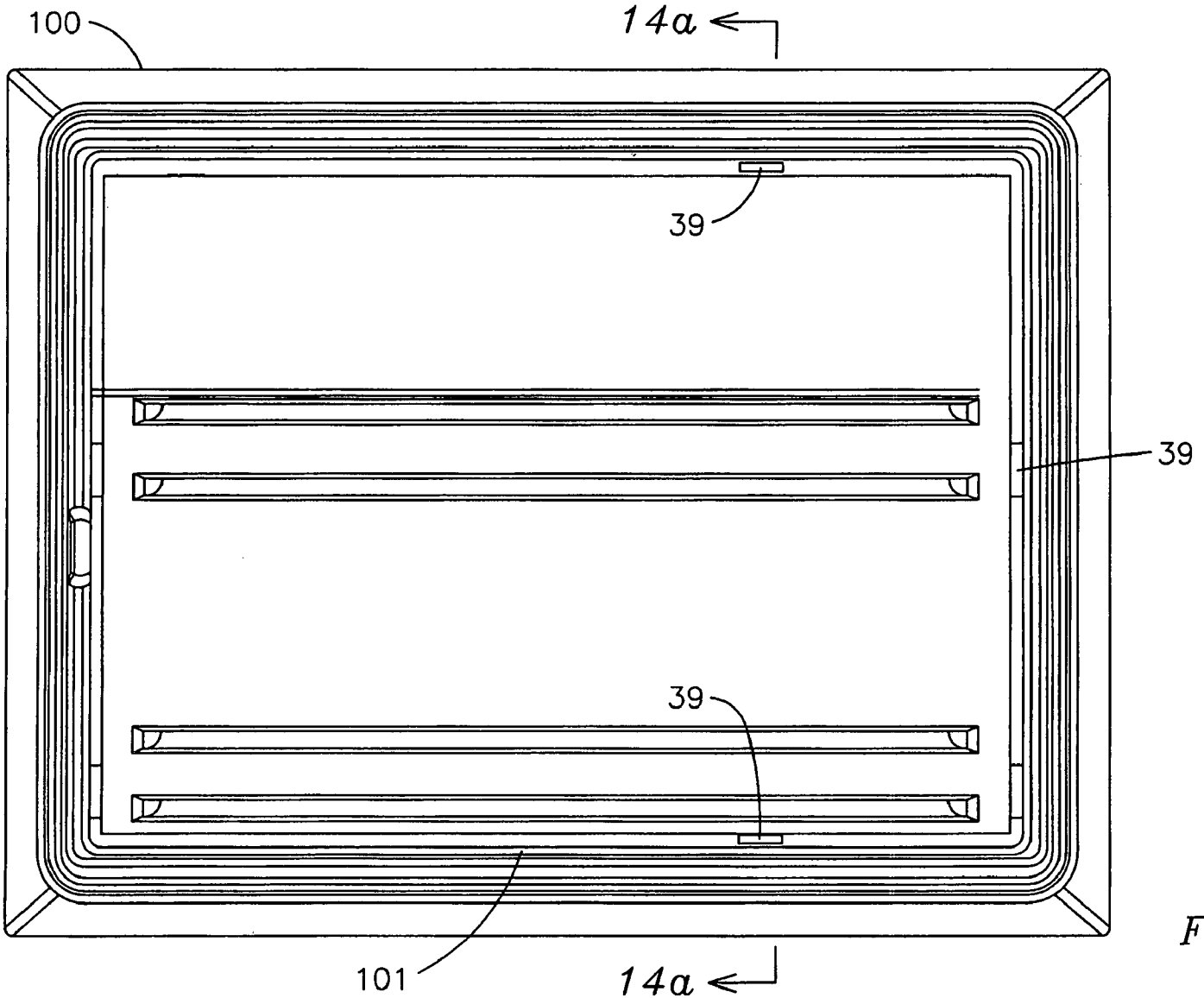
FIG. 14 is a front view of an exemplary liner of a freezer door where the ice-cube making device may be mounted.

In one exemplary embodiment, the case 10 may be attached to the freezer door 210 by means of a rack 60 (FIG. 2). The liner 100, as shown in FIGS. 14 and 14*a*, may be provided with affixing means, such as may comprise one or more receiving slots positioned at its lower end, which are referred to herein as lower liner guiding slots 101. The affixing means may further comprise protuberances 39, e.g., trapezoidally shaped protuberances or any suitably-shaped affixing structure, that, for example, may be provided in both a horizontal upper section and a vertical section of the liner to enable the rack 60 to get attached to the liner in cooperation with a lower pin 38 (FIG. 2*b*) provided at the lower end of the rack.

FIG. 2 shows an isometric view of the rack 60 where one or more tabs 37 are shown. The tabs 37 may be attached to the affixing structure, e.g., protuberances 39, provided in the liner 100. The rack 60 may also include a lock tab 36, which prevents axial movement of the rack 60 with respect to liner 100, once the rack 60 is attached to it.

Figure 4:
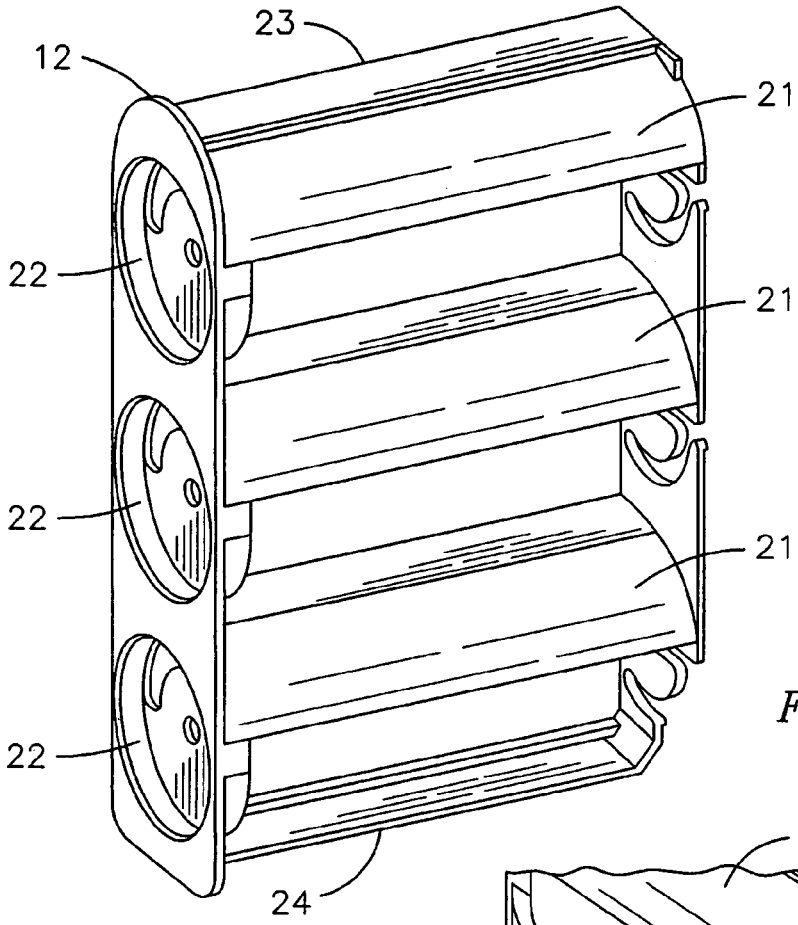
FIG. 4 is an isometric view of a magazine that may be slidably inserted through the side opening in the case of FIG. 3.

FIG. 2 further shows a top rail 41 that facilitates, magazine 12 to slide in or out the ice-cube making device 220, in cooperation with a top skid 23 provided in magazine 12, as shown in FIG. 4. The top skid 23 is connected to the top rail 41, which may be provided with a series of vents, thus allowing airflow through them, and also lightening the weight of the rack 60.

Figure 3:
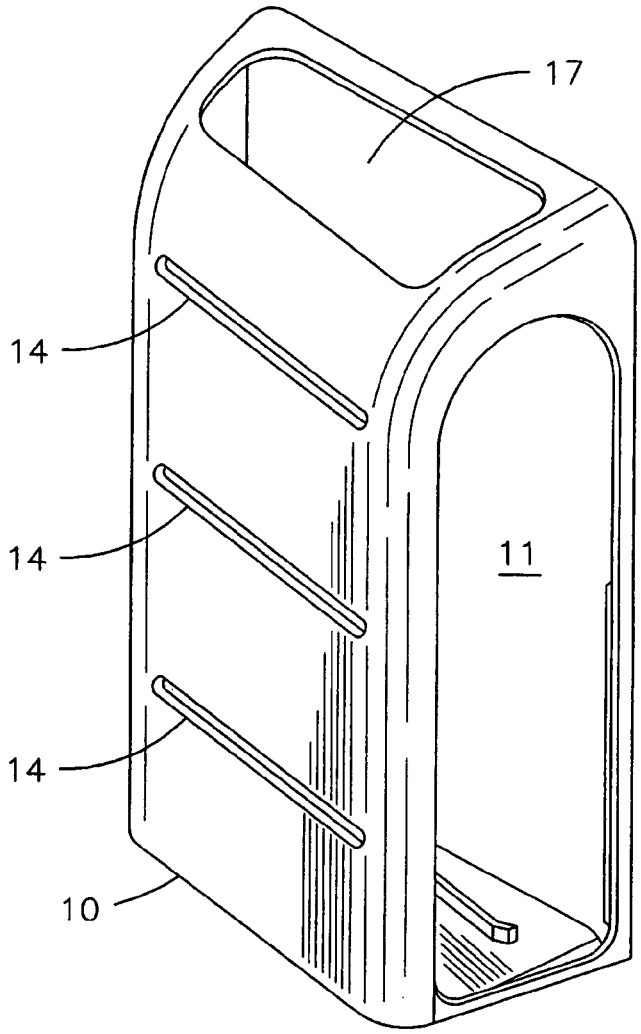
FIG. 3 is an isometric view showing structural details regarding a side opening and a top window in a case which is part of the ice-cube making device of FIG. 1.
Figure 3A:
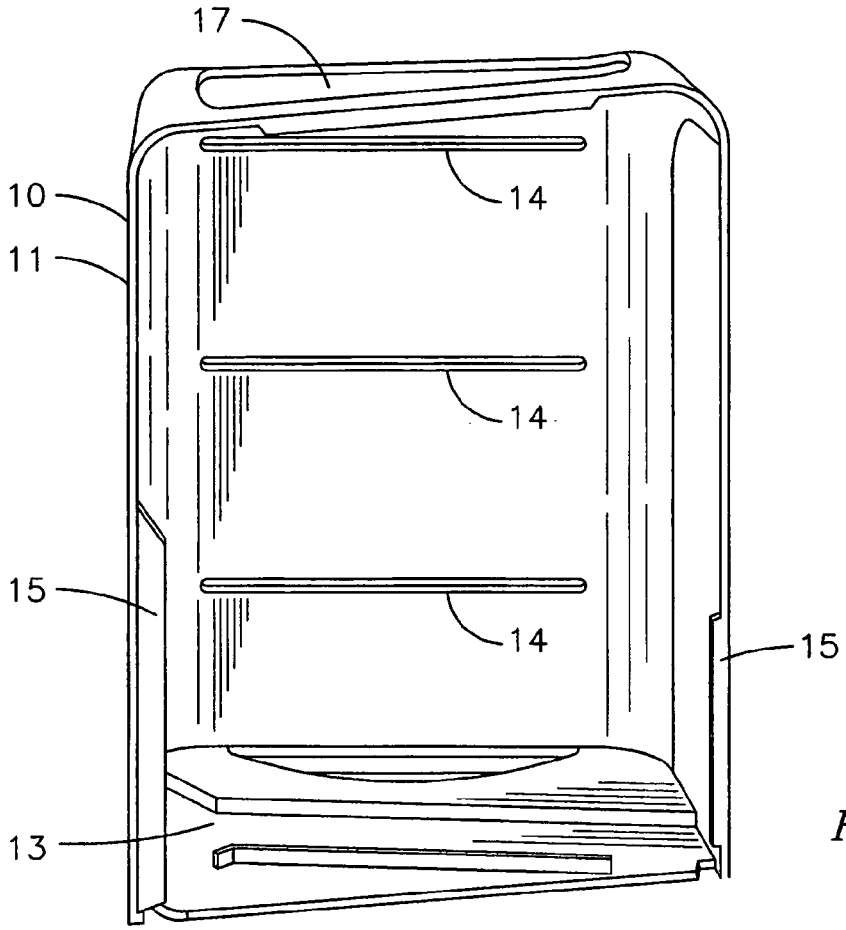
FIG. 3*a* is an isometric view showing additional structural details for the case of FIG. 3.

Referring again to FIG. 2, rack 60 includes guide tabs 45 that may be received by guides, e.g., C-shaped guides 15, in case 10, as shown in FIG. 3*a*. The guide tabs 45 generally run lengthwise relative to the vertical axis of the rack and may extend up to an appropriate height so that, for example, case 10 can be removed at about one-half of the total height of the rack. The top rail 41 and the base of a bottom rail 42 located above the space for the drawer 120, are also shown.

In one exemplary embodiment, rack 60 may be made of thermoplastic material (e.g., injected thermoplastic material) or any suitable polymer material, such as polyethylene, polypropylene, polystyrene, polyurethane, acrylic resin, etc. The rack 60 may be analogized to a lidless shoebox positioned in a vertical standup position, the base of which is one of the minor-area walls of the imaginary box. The side walls may be generally parallel to each other and are normal to the base. The entire surface area of the side walls of the rack need not fully extend to meet the upper side of the rack since a section of them may just extend to approximately ⅓ of the total height of the rack. The shortened side wall sections together with the back wall form a receiving cavity 32 (FIG. 2) for ice cube drawer 120.

The back wall of the imaginary shoe box may extend generally vertically up to a section where it slants inwards at about 5–25 degrees until reaching the top wall of the ice-cube making device 220. Each side wall may be different in width. In one exemplary embodiment, the narrower side wall may include the tabs 37, located above the cavity 32 for receiving drawer 120. The free edge of each side wall may be provided with a guide tab 45, which facilitates the assembly of case 10. Each guide tab may be positioned just along the free edge of the side walls and in a number sufficient to securely hold case 10 in place, and facilitate quick assembly. This feature is also helpful for user convenience since as the case is mounted on the freezer door, often located above the refrigerator door, the user should not necessarily be a tall person in order to perform cleaning and/or servicing of the device.

Figure 2A:
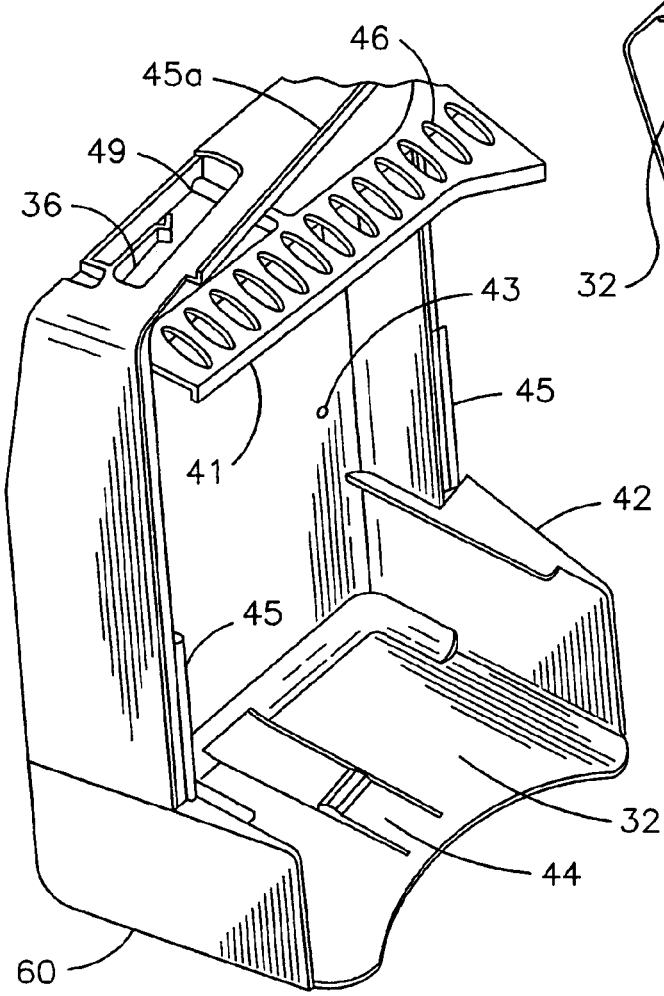
FIG. 2*a* is an isometric view illustrating further structural details regarding the rack of FIG. 2.

FIG. 2*a* shows an isometric top view of the rack 60, where the top rail 41 provided with vents 46 is shown. The top rail 41 is located at the top of the rack 60, just below the top section thereof. The top rail 41 may have a wider end section near the opening for receiving the magazine 12. This feature facilitates user insertion of the magazine 12. The top rail 41 may be profiled in a C-shape configuration.

The lock tab 36 (FIG. 2) may be located at the top of the rack 60, near either of the rear corners. The lock tab may be circumscribed by a recess 49, which also receives a respective upper protuberance 39 in liner 100. For example, protuberance 39 may slide into recess 49, and the recess 49 in one exemplary embodiment may be at least twice as long as the lock tab 36. In one exemplary embodiment, this protuberance 39 may be of approximately the same length as a length measured between the tip of the lock tab and the base of the tab.

At the end of recess 49, a gap may be formed, since this portion of the recess is not occupied by the lock tab 36. This gap acts as a bay for the respective protuberance 39, and, once the protuberance is introduced therein, the rack may slide in the direction of the lock tab 36. For example, the head of the lock tab may move in the direction of the back wall of the rack 60, until the respective protuberance 39 is inside the lock tab. The head of the lock tab may have a locking feature, e.g., triangular feature, and this prevents rack 60 from moving axially. If one desires to axially displace rack 60, one may push the lock tab 36 towards the back wall of the rack 60. This action may be performed using a screwdriver or similar tool.

FIG. 2 also shows at least one opening (e.g., screw hole 43), which may be used in the event an alternative affixing means to the liner is needed. For example, the alternative fastening means may be used during a repair to attach the rack 60 to the liner 100, such as by way of screws, rivets or any other fastening means that may fit through the screw holes 43.

On the top wall of the rack 60, a rectangular body extends along the top wall, and protrudes upwards along the vertical axis. This is called top guide tab 45*a*, and may function to fasten the top of case 10, and to provide a limit to vertical movement of the case upon being assembled into the rack. FIGS. 2 and 2*a* show the top guide tab 45*a* that may be received by a corresponding top C-guide 19 (FIG. 3*b*) in case 10.

Figure 2B:
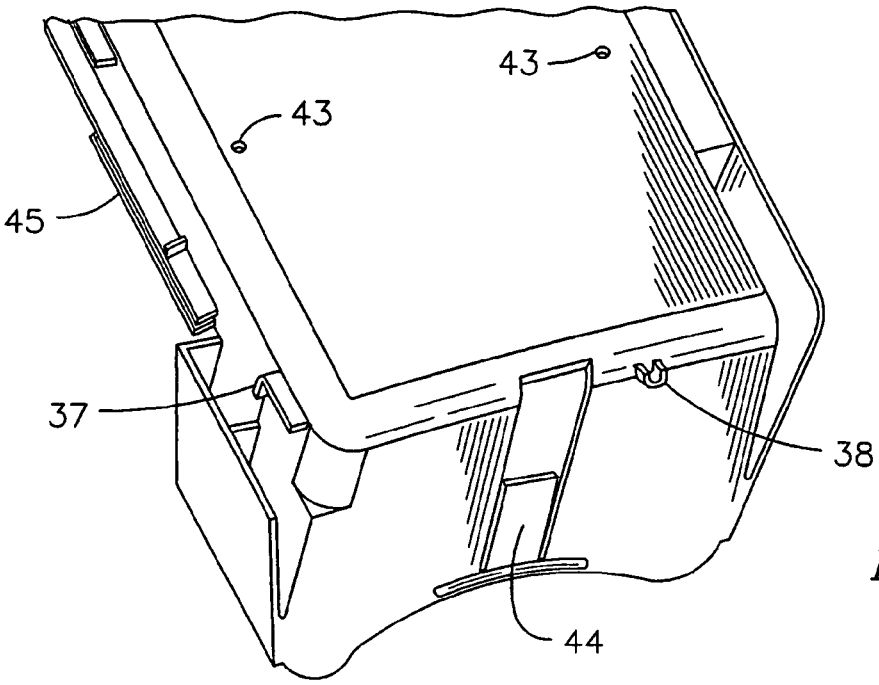
FIG. 2*b* is an isometric view of the bottom of the rack of FIG. 2.
Figure 7:
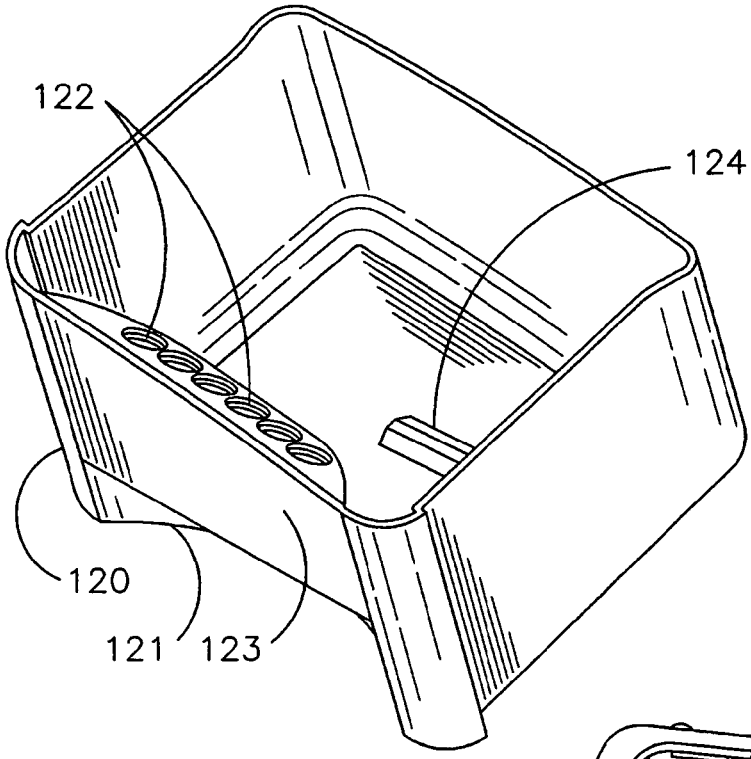
FIG. 7 is an isometric view of a drawer for collecting ice-cubes from the ice cube tray.

FIG. 2*b* is an isometric bottom view of the rack 60, and in part shows a drawer bottom lock 44, which may be of a springboard type. When inserting drawer 120 into the drawer receiver 32, the base of the bottom rail base 42 limits the height of drawer receiver 32 and prevents vertical movement of ice drawer 120. A relatively tight spacing between the drawer and the bottom surface of the drawer receiver causes deformation in the drawer bottom lock 44 until the drawer 120 reaches a locking condition. The drawer bottom lock 44 stops deforming itself when its rounded tip is housed inside a lower stop 124 of drawer 120, as shown in FIG. 7.

FIG. 2*b* also shows the lower pin 38, which may be inserted in the guiding slot 101 of the lower section of the liner 100, shown in FIGS. 14 and 14*a*. FIG. 2*b* also shows the position of one of the tabs 37 through which a corresponding one of the affixing protuberances 39 in the liner 100 may be introduced. It also shows the location of one of the guide tabs 45 providing another exemplary visualization of this arrangement with respect to the rack 60.

FIG. 3 is an isometric plan view of case 10, such as may be made of a suitable thermoplastic material (e.g., injected thermoplastic), or any suitable polymer material able to support freezing temperatures without affecting dimensional tolerances and also resistant to mechanical impacts. Examples of polymer material may be polyethylene, polypropylene, polystyrene, polyurethane, acrylic resin, and any other equivalent material.

In one exemplary embodiment, the case may be configured as an open rectangular prism, the base of which is the minor-area side. One of the lateral sides includes side opening 11, which allows the introduction of magazine 12. The case may be round-shaped at the top and includes case top window 17, which enables flow of cold air coming from the air chamber of the refrigerator. The side of largest area may be the frontal face, and may be optionally provided with the air inlet slits 14, which operate to introduce additional cold air into the ice-cube trays 50. It will be appreciated that aspects of the present invention may be fully realized without these optional air inlet slits 14.

FIG. 3*a* shows an isometric rear plan view of the case 10, and provides a more detailed view of a lower slider 13, which facilitates introduction of magazine 12 into the case 10. The slider may be formed by an intermediate protuberance and a step at the bottom of the case 10. The slider and the top rail 41 may be provided with a tapered opening to facilitate,the introduction of magazine 12 into the ice-cube making device 220. The C-guides 15 are also shown in FIG. 3*a*, and are respectively located on the rear edge of the lateral sides of the case, protruding perpendicularly to said lateral sides towards an imaginary central line that divides the rear side of the case in two halves. It is noted that one of the C-guides may be of longer length than the other one. This is due to the specific geometry chosen for the sidewalls of the rack 60. It will be understood that other geometrical configurations can work equally effective.

Figure 3B:
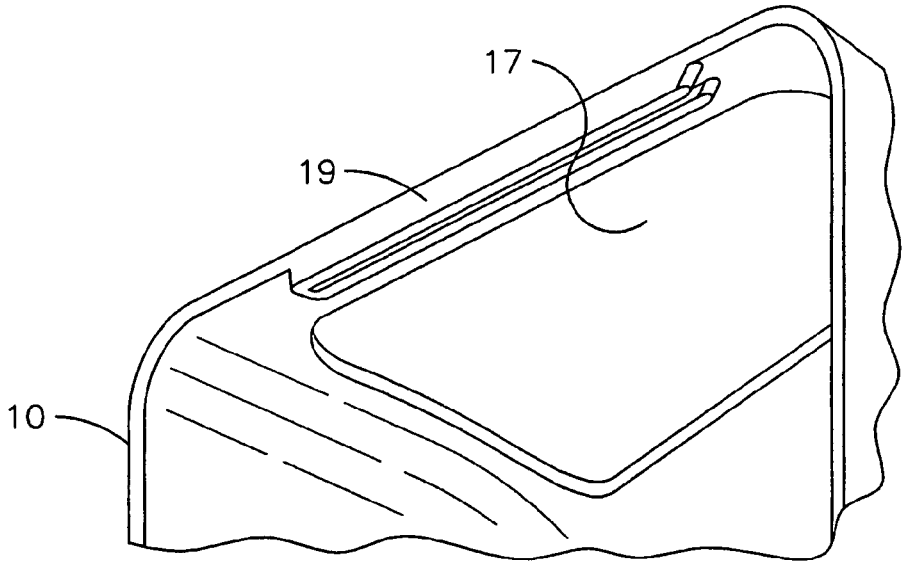
FIG. 3*b* shows structural details regarding mounting guides that may be used in the case of FIG. 3.

FIG. 3*b* is an isometric view of the top section of case 10, where another C-guide is located inside and to the rear of the top side of the case 10. Top C-guide 19 protrudes from the inside top side of the case, perpendicularly downwards to the vertical axis of the case. Said C-guide houses the top guide tabs 45*a* located on the top wall of the rack 60 as shown in FIGS. 2 and 2*a*. FIG. 3*b* also shows top window 17.

FIG. 4 shows the magazine 12 and one or more knob cavities 22 located on one side of magazine 12. Also ramps 21 are shown that have a generally curved configuration following an arc generally determined by the radii of the knob cavities 22. Ramps 21 extend throughout the width of magazine 12. Said ramps 21 act as deflectors for both the air flow and the ice cubes when released from the tray. Assuming the absence of these ramps 21, upon releasing the ice cubes from the mold they would tend to impact the immediate lower mold thereby making it difficult for the ice cubes to reach drawer 120.

FIG. 4 also shows the top skid 23 and the bottom skid 24, which facilitate the introduction of magazine 12 inside ice-cube making device 220. These skids slide inside the case, traveling on the top rail 41 and the lower slider 13. The top skid 23 is located at the top of magazine 12, and protrudes from the upper knob cavity 22. In one exemplary embodiment, the top skid 23 may have a T-shaped profile and the leg of the T may be supported along the width of the upper-most ramp 21, and the horizontal section of the T rests on top of the magazine 12, as shown in FIG. 4*d*.

Figure 4A:
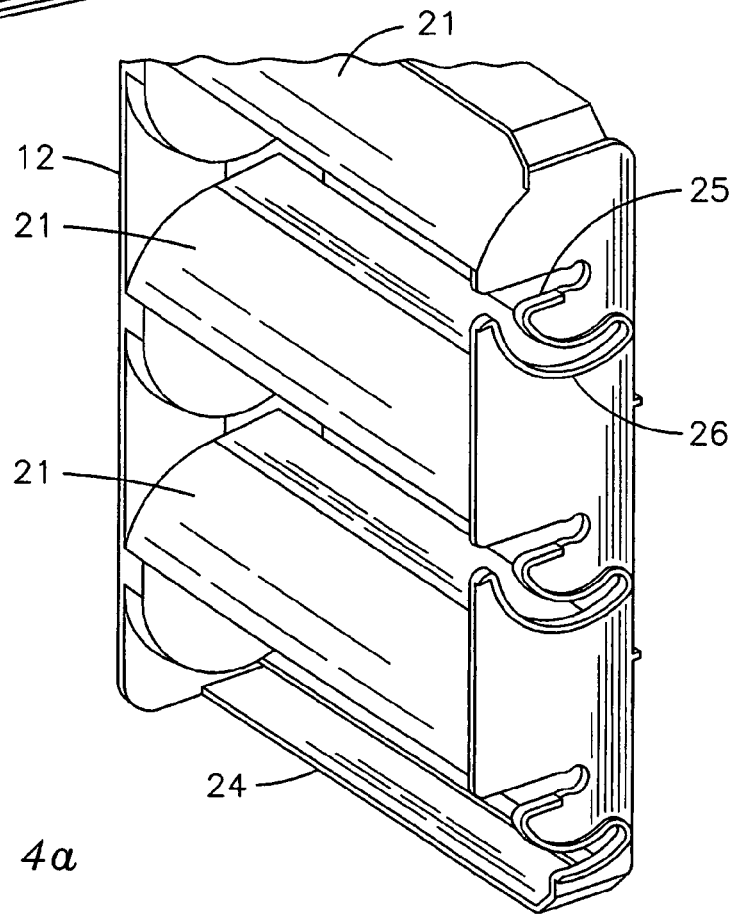
FIG. 4*a* is an isometric view showing structural details for the magazine of FIG. 4.

FIG. 4*a* is an isometric rear view of a fastening and ice-extraction mechanism for the ice-cube trays 50. On a side opposite to the side bearing the knob cavities, there is a cutout 25 and an arcuate slide 26. The cutout 25 extends horizontally until reaching a circular end which houses a rear central pin 52 of the ice-cube tray 50 shown in FIG. 5. Each arcuate slide 26 defines a slot having a radius approximately equal to the distance between the rear central pin 52 and the rear limit pin 53 of the ice-cube tray 50.

Figure 4B:
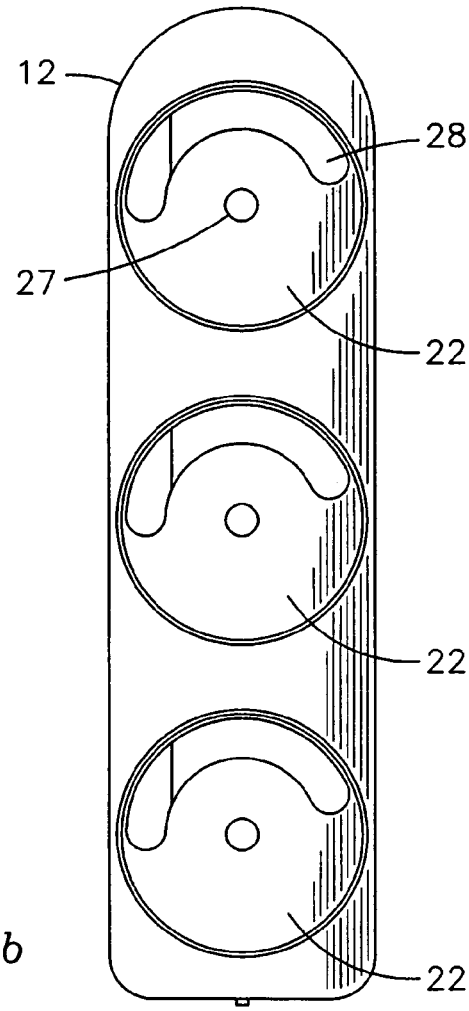
FIG. 4*b* is a side view of the magazine of FIG. 4.

FIG. 4*b* shows a side view of magazine 12 showing the details of location of knob cavities 22. Knob cavities 22 in addition to house knobs 40, hold a knob pin 54, shown in FIGS. 5 and 5*a*, which is inserted trough the shaft hole 27 and the front limit pin 55, which slides inside the arcuate slide 28.

Figure 4C:
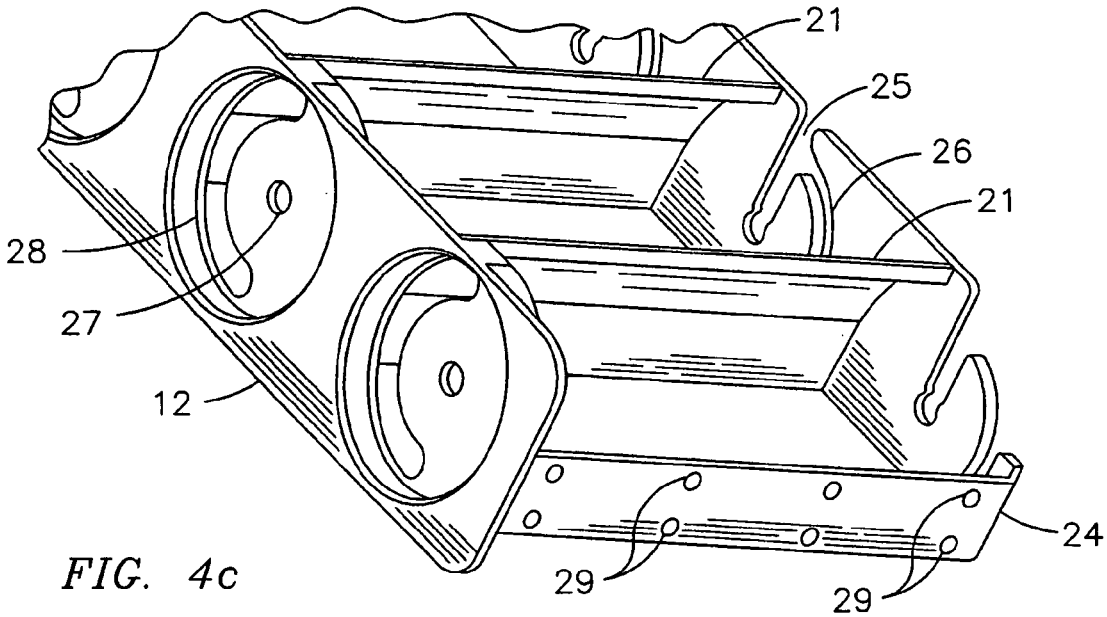
FIG. 4*c* is an isometric bottom view showing additional structural details for the magazine of FIG. 4.
Figure 4D:
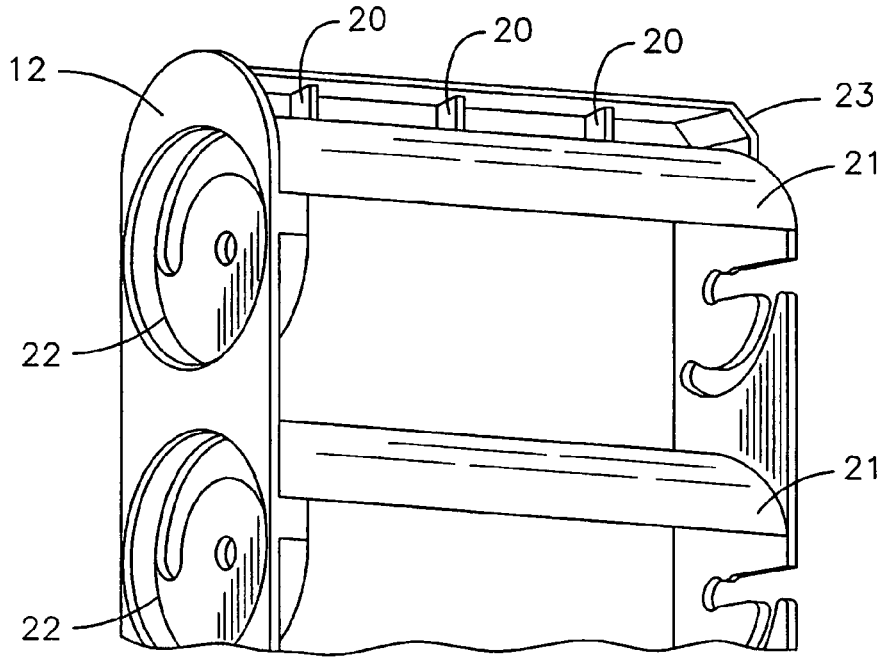
FIG. 4*d* is an isometric top view showing structural details of a top skid that may be used in the magazine of FIG. 4.

The bottom skid 24 is seen in detail in FIG. 4*c*, and in one exemplary embodiment may be made up of a rectangular plate located at the bottom of magazine 12, and connects the two sides of magazine 12, originating in the rear wall, thereby providing support for the entire magazine. A series of support bumps, e.g., semi-spheres, may be provided at the bottom of the skid, projecting on the surface and thereby reducing the contact area and the force required to slide the magazine 12 on the lower slider 13. The semi-spheres are referred to herein as anti-frictional separators 29.

FIG. 4*d* shows exemplary reinforcements in upper skid 20, and a chamfer located at a side opposite the side bearing the knob cavities 22. Said chamfer enables an easy introduction of magazine 12 into the upper C-guide.

Figure 5:
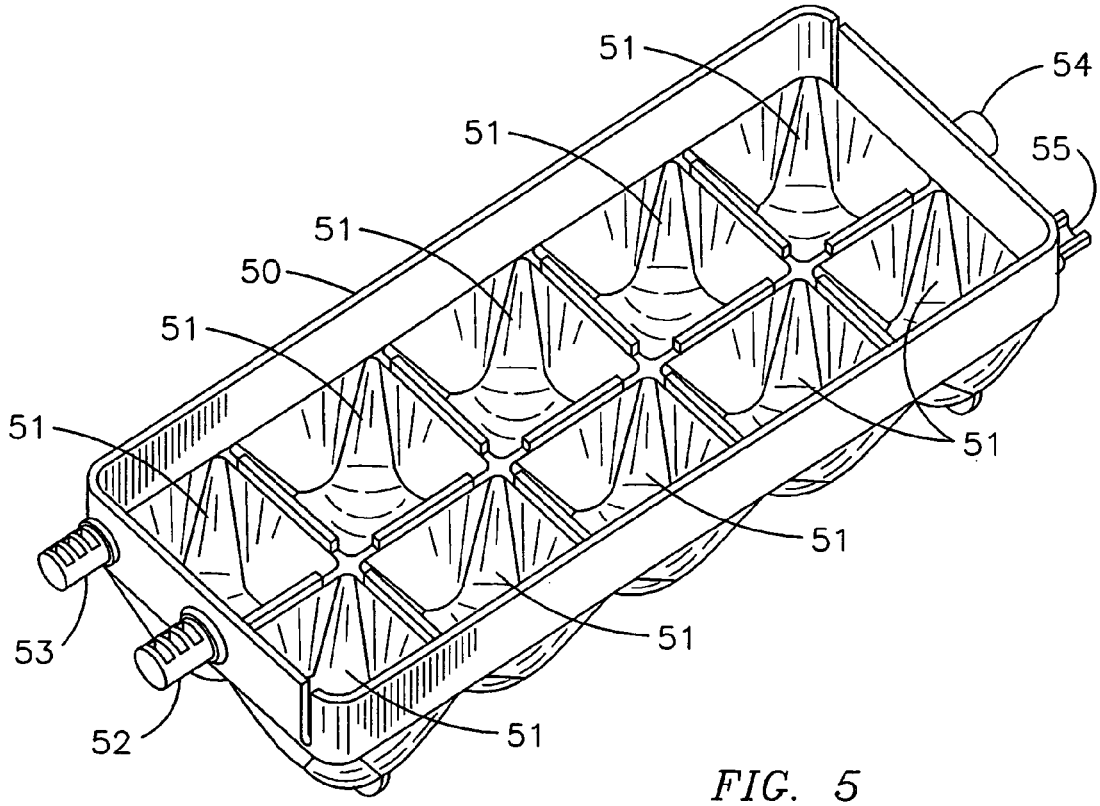
FIG. 5 is an isometric view of an exemplary ice-cube tray that may be part of the ice-cube making device.

FIG. 5 shows an exemplary ice-cube tray 50, which includes a receptacle for holding water, referred to as water container 51, in which water solidifies into a desired mold shape. It is also shown that the periphery of the ice-cube tray 50 is provided with a relatively tall wall for containing the liquid when the ice-cube tray 50 rotates around a longitudinal axis and avoiding splashes while water is in liquid state, and facilitating the transportation and filling of the ice-cube trays 50. The longitudinal axis may run between a front pin 54 and a rear pin 52.

Figure 5A:
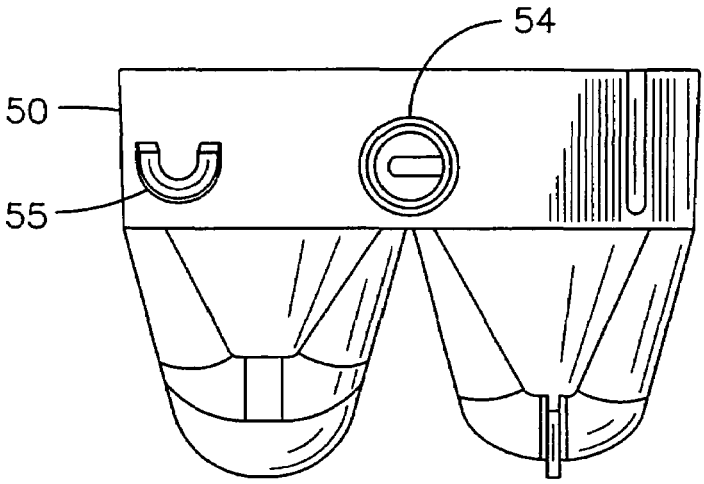
FIG. 5*a* is a front view of the ice-cube tray of FIG. 5.

FIG. 5*a* shows the front pin 54 and a front limit pin 55 cooperating together with the rear pin 52 and the rear limit pin 53, by being inserted into a shaft hole 27, a front arcuate slide 28, cutout 25, and the rear arcuate slide 26 respectively. By means of knob 40, a torque is applied and transmitted via the knob pin 54, thereby imparting a pivotal movement to the ice-cube tray 50 along the longitudinal axis of the ice-cube tray 50, and turning the tray around until the rear limit pin 53 travels on the rear arcuate slide 26, up to the end of its run. This action deforms the shape of the ice-cube tray by forcing its long sides into a helix-like configuration generally following the direction of the axis passing through the knob pin 54 and the rear central pin 52; the deformation stops when the front limit pin is reached at the end of the run of the front arcuate slide 28. It will be appreciated that to enhance the twisting action of the tray in response to the applied torque, the respective limit pins are generally positioned at or near diagonally opposite corners of the tray.

In operation, the walls of the water container get deformed and in part due to its generally prismatic geometry the releasing of the ice cubes from the mold is achieved. Subsequently the ice cubes are expelled from the deformed ice-cube tray 50, such as may be made of thermoplastic material (e.g., injected thermoplastic) or any suitable polymer having a relatively high deformation modulus, high memory and fatigue strength, capable of supporting relatively high temperature changes, and a high impact strength, in addition to complying with any applicable toxicological, bacteriological and health regulations. Examples of polymer material may be polyethylene, polypropylene, polystyrene, polyurethane, acrylic resin, and any other equivalent material.

Figure 6:
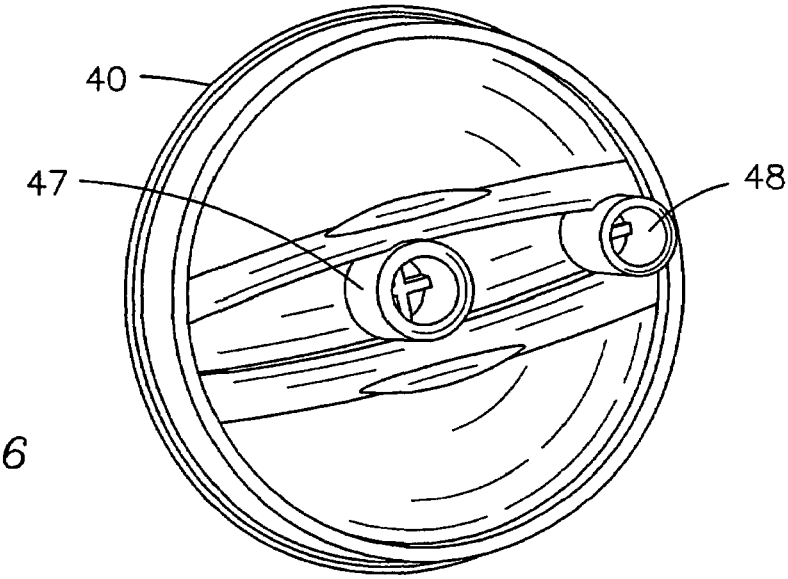
FIG. 6 is an isometric rear view of a knob used in the ice-cube making device that may be actuated for causing ice cubes to be dispensed from the ice-cube making device.

FIG. 6 is an isometric rear view of a knob 40 showing a tubular knob-receiving projection 47, and a tubular receiving projection 48 for the knob pin 54 and the front limit pin 55, respectively, as shown in FIG. 5*a*. Both projections may be of a so called tight fit type. By way of example, assembly may take place by placing the ice-cube tray 50 in an appropriate position inside magazine 12.

Figure 6A:
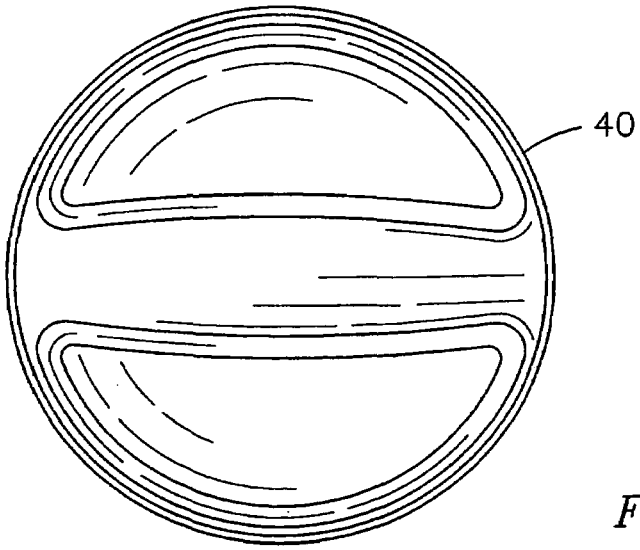
FIG. 6*a* is a front view of the knob of FIG. 6.

FIG. 6*a* is a front view of knob 40 showing its geometry and appearance. Knob 40 may be made of a thermoplastic material (e.g., injected thermoplastic material) or polymer material of medium elastic modulus, shock-resistant and relatively resistant to abrupt changes of temperature, so as to not change its dimensional tolerance. Examples of polymer material may be polyethylene, polypropylene, polystyrene, polyurethane, acrylic resin, and any other equivalent material.

The drawer 120 receives the ice cubes expelled from the ice-cube trays 50, and is located at the lower part of the ice-cube making device 220. In FIG. 1, the drawer has a rectangular shape with somewhat rounded corners so as to avoid the presence of sharp angles or cutting edges for safety reasons.

FIG. 7 is an isometric top view of the drawer 120 showing vents 122 that allow entrance of a downwards flow of air, e.g., coming from the case top window 17. The air flow may travel through the inside of the ice-cube making device 220, and the vents 122 direct the air flow to go through an air duct 123, which may be formed by the front face of the drawer.

In one exemplary embodiment, the inner front wall of the drawer may be generally curved and may be joined to the floor of drawer 120. This feature need not be present in the outer front face because this outer face could be truncated so as to configure a puller 121 at a sufficient height so that the fingers of the user may be readily introduced. The floor of the drawer may be provided with a recess that houses the drawer bottom lock 44 shown in FIG. 2*b*, which acts to lock drawer 120 in the proper position inside the ice-cube making device 220.

Figure 8:
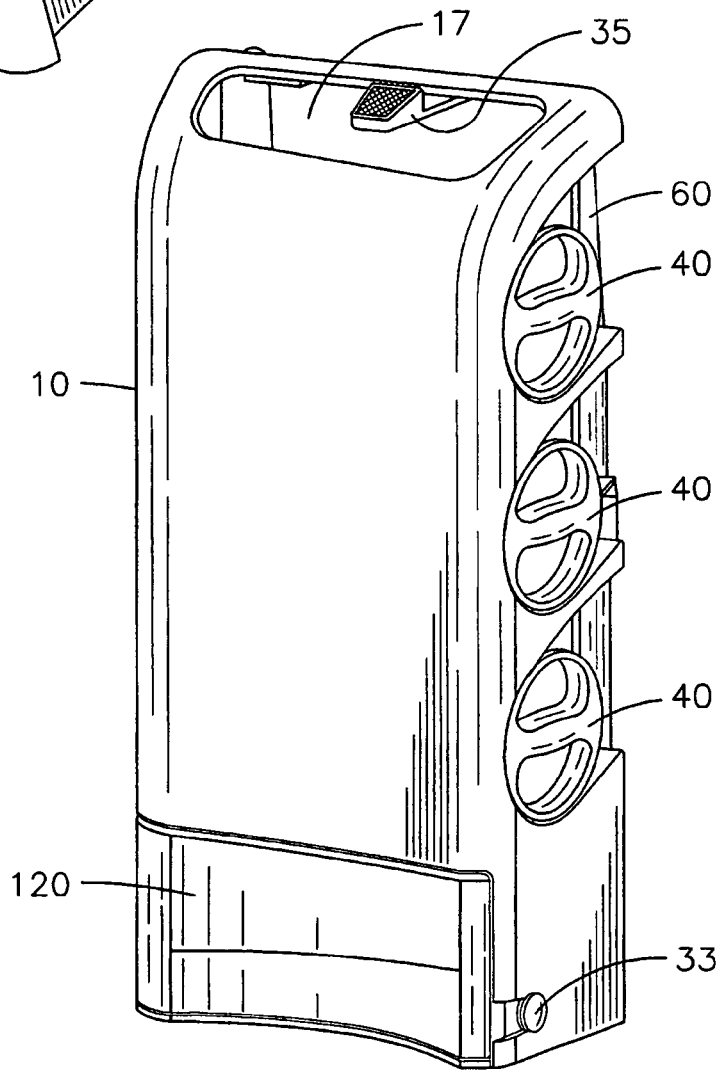
FIG. 8 is an isometric view of another exemplary embodiment of an ice-cube making device in accordance with aspects of the present invention.

FIG. 8 is an isometric view of a second exemplary embodiment of the ice-cube making device 220. More particularly, FIG. 8 shows a case lock 35 located at the top of the case 10. Lock 35 secures the case to the rack 60. A pivot bolt 33 is located at the bottom of the ice-cube making device 220, and it operates to allow case 10 to pivot forwardly to be in an open condition.

Figure 9:
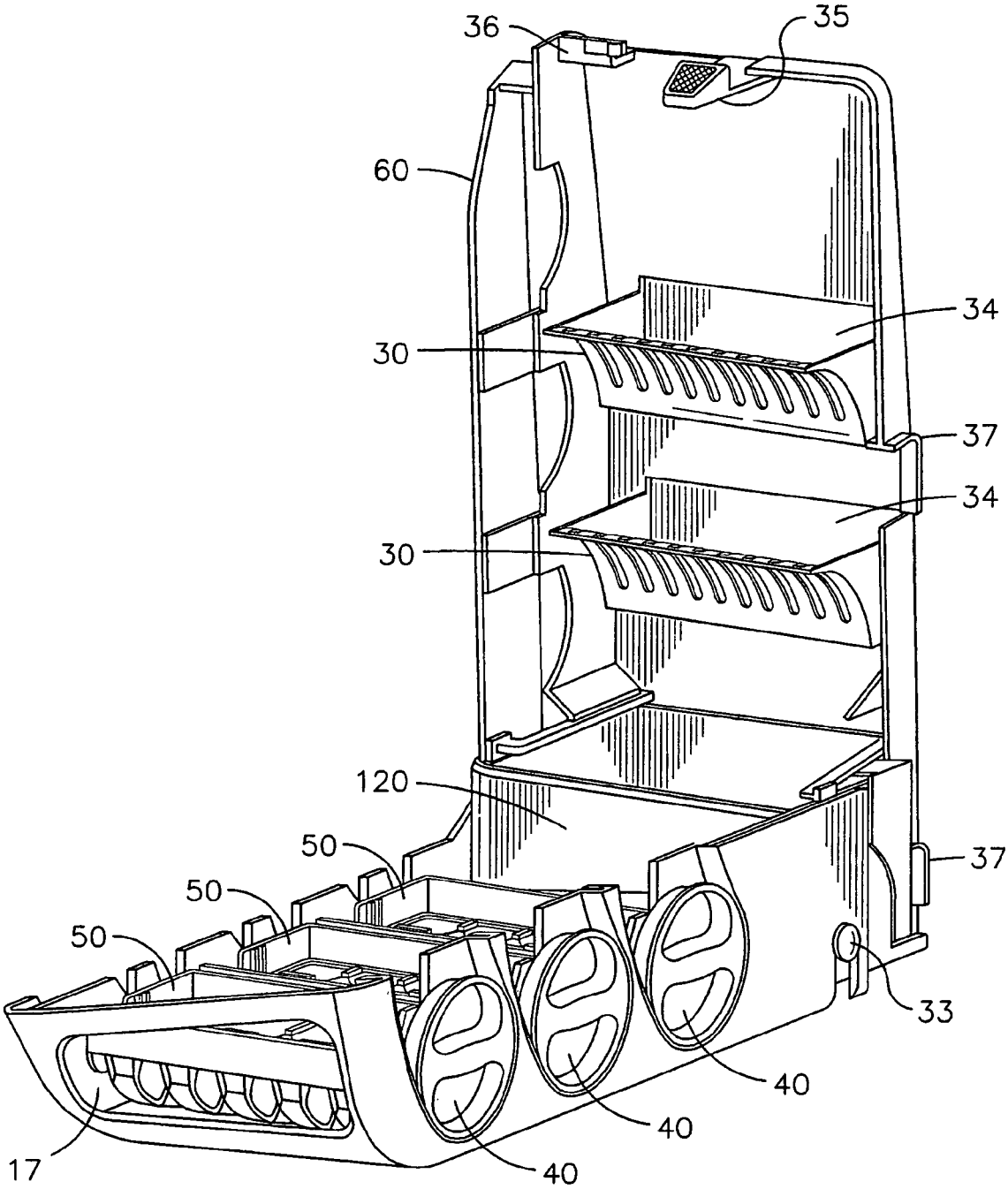
FIG. 9 is an isometric view of the ice-cube making device of FIG. 8 illustrating an exemplary case in an exemplary open condition.

FIG. 9 shows additional structural details regarding this embodiment. By way of example, case 10 is shown lowered down at an angle of about ninety degrees. It will be appreciated, however, that the case may be lowered down up to any desired angle, lower or higher than ninety degrees. For example, down up to about one hundred and eighty degrees, presuming the case is provided with a suitably configured stop mechanism and cam recesses allowing it to adopt the desired angle. It is contemplated that the pivoting mechanism may be configured for bringing the case into an open condition by forwardly pivoting the case to an angle in the range from about 0 degrees to about 180 degrees.

In one exemplary embodiment, the pivoting mechanism for bringing the case into an open condition may include a notched cam configured so that the case may be stepwise pivoted to a desired angular position. Alternatively, the pivoting mechanism for bringing the case into an open condition may include a smooth cam configured to forwardly pivot the case in a single step to a desired angular position. Also, the case may be forwardly pivoted in a single step to an angle of about 90 degrees, and thereafter pivoted at predetermined angles till reaching the 180 degree position. In this example, the cam may comprise a notched segment up to 90 degrees and may further comprise a smooth segment till reaching the 180 degree position.

The ramp-shaped vanes 30 in this embodiment may constitute an integral part of the rack 60, and may form ice cube passage 34. The magazine 12 in this embodiment is absent, and the ice-cube trays 50 may be removably connected to the case, so that when the case is lowered down, as shown in FIG. 9, the ice-cube trays can be removed, cleaned, serviced, or refilled.

This embodiment also includes a self-tipping mechanism due to structural features in the ice-cube tray 50, such as the central projections that allow pivotal movement along the longitudinal axis of the tray, and thus case 10 can be closed without spilling water, and, as in the first-described embodiment, any sudden or rapid opening of the freezer door 210 can be tolerated by converting an acceleration of the door into a centrifugal force that holds the liquid in place.

It is noted that in this embodiment the entire case 10 may be removed from the rack 60 and transported along with the ice-cube trays 50. This may be done by lowering down the case at an angle close to ninety degrees, holding with one hand the frontal face of case 10 and pushing with the other hand the bottom of case 10 so as to release pivot bolt 33 of the rack 60 from the bolt slot 16.

Figure 10:
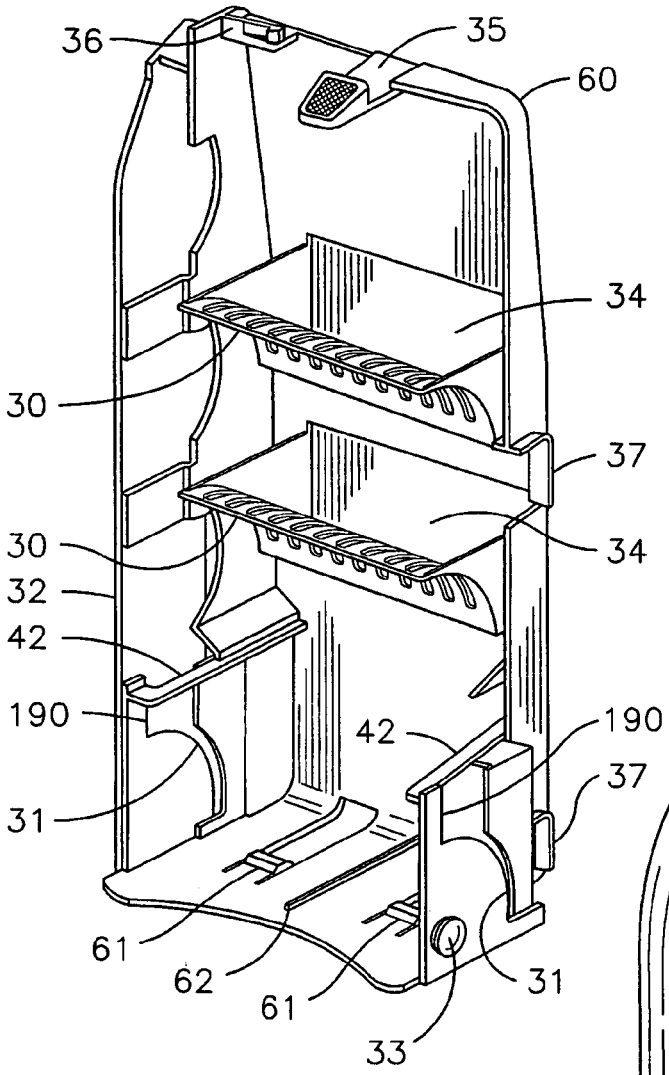
FIG. 10 is an isometric view of an exemplary support rack for the ice-cube making device of FIG. 8.

The rack 60 shown in FIG. 10 may be attached to the liner 100 of the freezer door 220 in essentially the same way as in the first embodiment, and will not be described again.

At the top of the case there is case lock 35, which may have a wedge-shaped head and its body may be arranged as a springboard, the thinnest part of the wedge-shaped head is introduced under the top of case 10, resulting in the deformation of case lock 35 downwards along the vertical axis. Once the deformation force stops acting, the case lock 35 secures the case 10. To lower down case 10 the head of lock 35 should be pressed down to deform the lock and release the case.

On the middle section of the rack we find the ramp-shaped vanes 30, which in this embodiment may be slotted to enable incremental air flow when assembled in the body of the rack 60. The vanes 30 together with the back wall of the rack 60 forms an ice cube passage 34, through which ice cubes can pass when expelled from the ice-cube tray 50. At the lower section of the rack 60 there is a mechanism that enables the case 10 to be lowered down. This mechanism comprises a pivot bolt 33 inserted into the bolt slot 16.

In operation, the case 10 turns around pivot bolt 33; there is a stop cam 31 on which a follower 18 of case 10 (shown in FIG. 11) follows its path when case 10 is lowered down, and interrupts its traveling at a given angle, such as in the range of about ninety degrees (however, an appropriately configured mechanism may enable lowering down the case up to one hundred and eighty degrees); the end of its travel is determined by a butt 190 provided in the case.

In the same lower section there is the drawer receiver 32, as in the first embodiment. The drawer receiver 32 may be defined by the lateral sidewalls of the rack 60 (which also bear the mechanism made up of stop cam 31 and case butt 190); the base wall of the rack 60, and at the top by the bottom rail base 42. At the base wall of the rack there is the drawer lock 61, in the form of a springboard with a cylindrical head, and the drawer rail 62, which may be arranged as a central structure running widthwise on the internal face of the base wall of the case.

Figure 11:
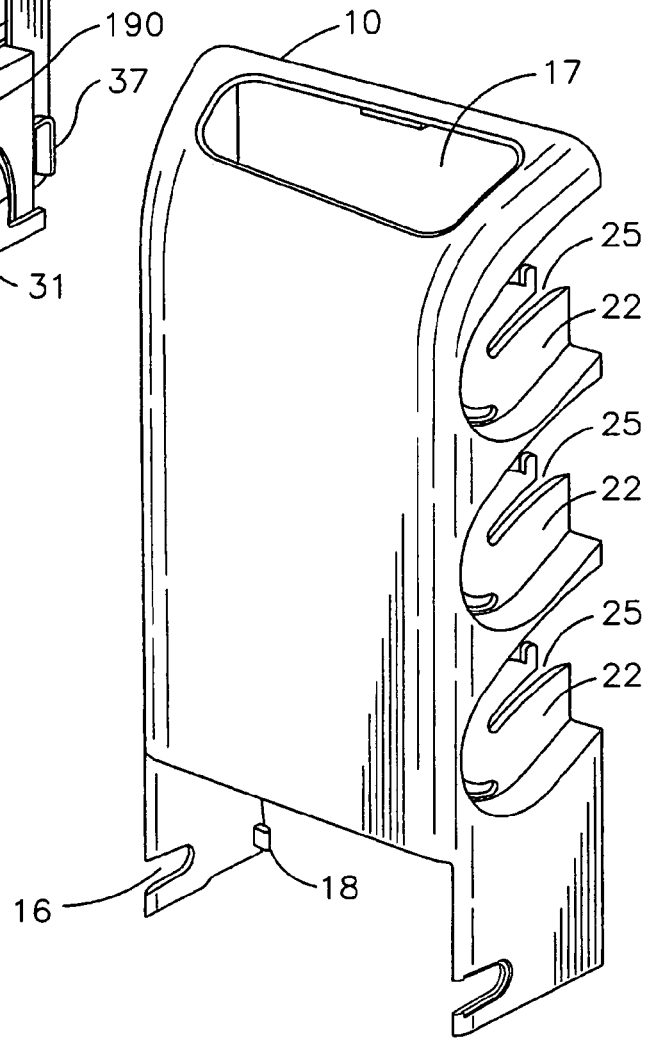
FIG. 11 is an isometric view of a front section of the case of the ice-cube making device of FIG. 8.

FIG. 11 is an isometric frontal view of the case 10 showing in detail exemplary knob cavities 22 that allow the insertion and removal of the ice-cube trays 50. This may be accomplished via the rear, without the need of withdrawing the knob 40, since an assembly channel that runs up to the rear of case 10 may be provided.

Figure 11A:
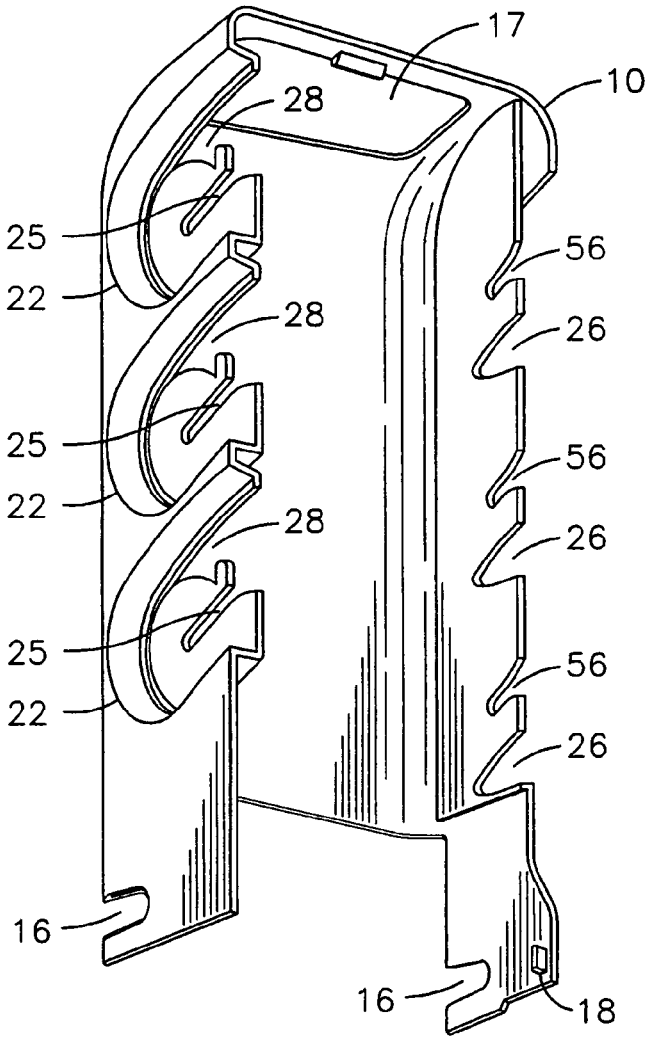
FIG. 11*a* is an isometric view of the back section of the case of the ice-cube making device of FIG. 8.

FIG. 11*a* shows the outlet of said channel and the assembly mechanism made up on one side by the following elements: a cutout 25 which is also a channel that runs to the rear of case 10; and a front arcuate slide 28 that receives the front limit pin 55 of the ice-cube tray 50; and on the opposite side, the rear central pin slot 56 located at the same height of the channel, and which receives the rear limit pin 53; the rear arcuate slide 26 located just below the rear central pin slot 56. On the lower section of the sidewalls of case 10, there are bolt slots 16 which receive the pivot bolts 33 allowing the case 10 to be lowered down.

Figure 12:
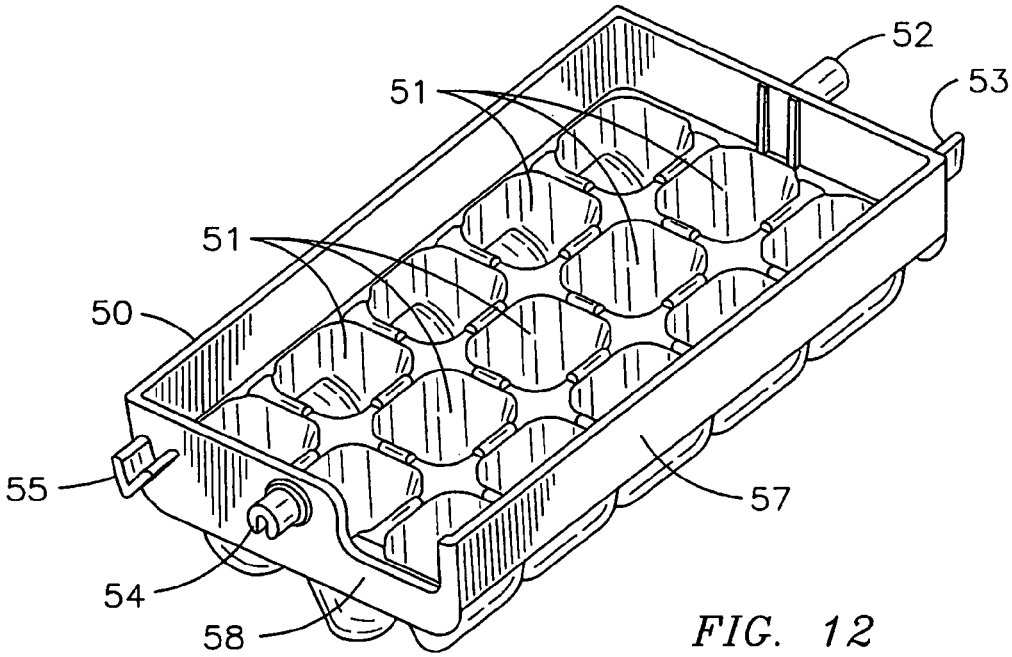
FIG. 12 is an isometric top view of an ice-cube tray of the ice-cube making device of FIG. 8.

FIG. 12 shows the ice-cube 50 tray and details the knob pin 54 and the front limit pin 55, which are to be attached to knob 40, they cooperate together with the rear central pin 52 and the rear limit pin 53 by being inserted in the cutout 25, the front arcuate slide 28, the rear central pin slot 56, and the rear arcuate slide 26, respectively. By means of knob 40 a torque is applied and transmitted through the knob pin 54 to create a momentum on the ice-cube tray 50, making the tray turn around until the rear limit pin 53 reaches the end of the rear arcuate slide 26, thereby causing the ice-cube tray to twist into a helix-like shape in the direction of its longitudinal axis that runs from the knob pin 54 to the rear central pin 52. Said deformation stops when the front limit pin reaches the end of the front arcuate slide 28. As a result of the tray deformation, the walls of the water containers 51 are also deformed, and by virtue of their prismatic geometry the ice-cubes are released and subsequent expelled from the deformed ice-cube tray 50.

The ice-cube tray 50 may be made of thermoplastic material (e.g., an injected thermoplastic material) or any suitable polymer material of relatively high deformation modulus, high memory, and high fatigue strength, and should be resistant to sudden temperature changes, and high shock-resistant, in addition to complying with applicable toxicological, bacteriological and health regulations. Examples of polymer material may be polyethylene, polypropylene, polystyrene, polyurethane, acrylic resin, and any other equivalent material.

Figure 13:
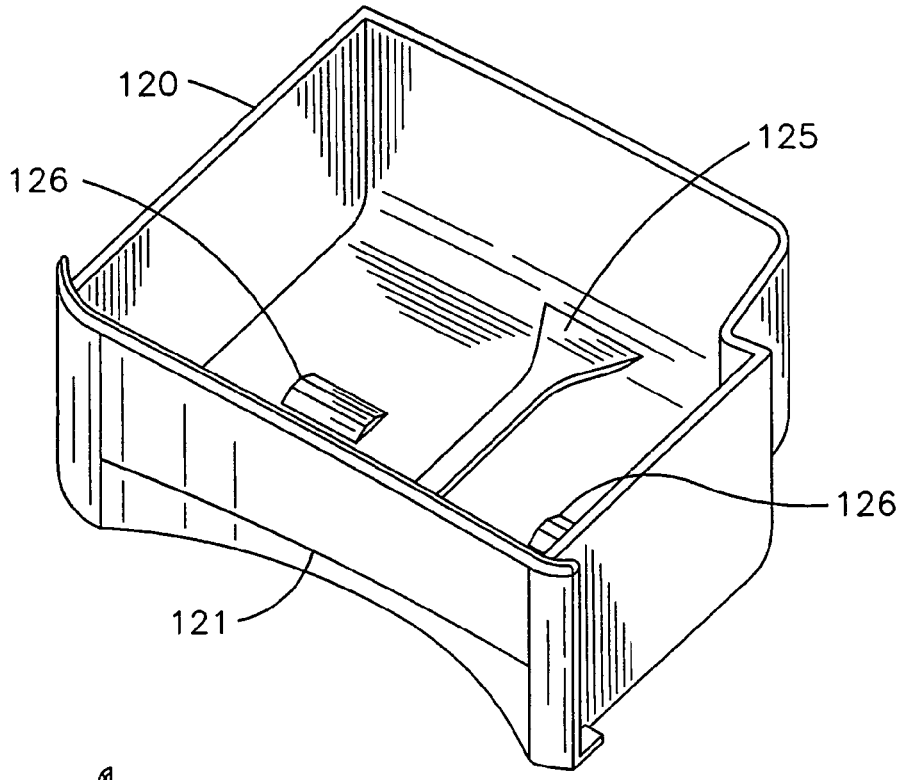
FIG. 13 is an isometric view of an exemplary drawer for the ice-cube making device of FIG. 8.

As illustrated in FIG. 13, in this second embodiment, ice-cube drawer 120 may exhibit some structural differences relative to the first-described embodiment. One exemplary difference is that there is no air duct and the air outlet for the ice-cube making device 220 is provided by the spaces provided between the drawer 120, the case 10, and the rack 60. In this embodiment, the drawer has a lower guide 125 which will house the drawer rail 62, and is useful to align drawer 120 during its introduction and removal from the drawer receiver 32. The drawer 120 also has a pair of cavities 126 which receive the lock head 61, once the drawer 120 has been introduced in the drawer receiver 32. The face of the drawer 120 may have an irregular shape with two basic geometries, the bottom section is a curved longitudinal surface extending to approximately one third of the total height of the face, the rest of the face is a flat surface; the longitudinal line where these two basic geometries converge forms the puller 121, by virtue of the flat surface being cantilevered a few centimeters.

Figure 15:
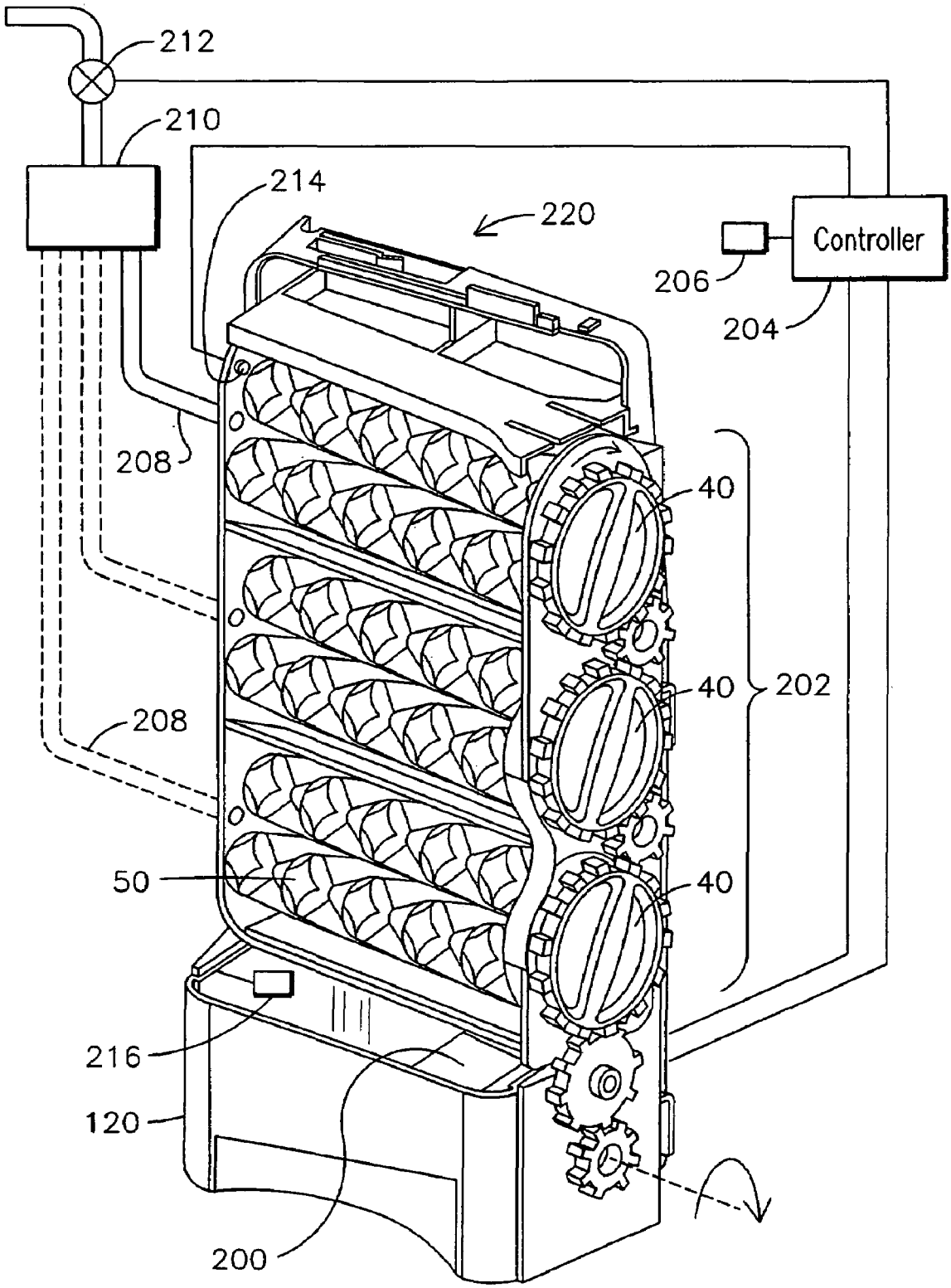
FIG. 15 is a schematic representation of an exemplary embodiment of an ice-cube making device with automated mechanisms for water filling of the ice-cube trays therein and for dispensing the ice-cubes that may be formed in the ice-cube trays.

The foregoing exemplary embodiments have been described as having basic manually operated features. It is contemplated, however, that aspects of the present invention may be automated by providing some relatively inexpensive components. For example, as illustrated in FIG. 15, an electric motor 200 may be connected to a gear mechanism 202 to provide the torque to actuate each knob 40. For example, the outer perimeter of each knob may be configured as a toothed perimeter, which becomes part of the gear mechanism for delivering the twisting torque to the ice-cube trays 50. The motor may be responsive to an ice-extraction command signal from an electronic controller 204 so that the motor causes rotation of the knobs and eventual twisting of the ice-cube trays to cause dislodging of ice cubes from the trays and passage of such ice cubes into drawer 120. For example, the controller 204 may be programmed to apply torque to the knob 40 at preset time intervals, and alert the user by way of suitable user-interface 206 as to the need for refilling wit water the ice-cube trays 50.

To prevent this inconvenience to the user, in one exemplary embodiment it is contemplated that one or more hoses 208 may be connected to a water manifold 210. A respective hose may be directed to each ice-cube cube tray 50 or a single hose may just to the uppermost ice-cube cube tray so that when that upper tray is filled up with water, a water cascading effect allows refilling the ice-cube trays below. A water valve 212, e.g., a two-way solenoid, may be actuated in response to a water-fill command signal from controller 204 to an open condition to perform a water filling operation. The one or more hoses 208 may be embedded within insulating foam located between the cabinet and the liner 100, to prevent the water from freezing within the hoses. The hoses may access the ice-cube making device 220 by means of one of the freezer lateral sides or by the upper side. A water level sensor 214, such as an floatable arm connected to a switch, may be provided in each tray to provide a signal to the controller 204. The signal may be indicative of the water level of the trays. Moreover, a sensor 216 may be provided in ice-cube drawer 220 to generate a signal indicative of the amount of ice-cubes collected in the drawer. The controller may be configured to process the respective signals from sensors 214 and 216 to generate the ice-cube extraction signal or the water filling signal, and thereby supply water into the ice-cube trays, or extract ice cubes from the ice-cube trays, depending on the indications from the respective sensors 214 and 216. One may be able to override the automated operation, by performing actions such as removing or lowering down the case 10, or removing the drawer 120 from receiver 32.

It is further contemplated that the drawer 120 may be removed even when the freezer door 210 is closed, this may be achieved by virtue of an access window provided on the outside of the door.

Although all the features and basic characteristics of the invention have been described herein, by making reference to particular embodiments thereof, different modifications, changes, and substitutions remain proposed in the foregoing specification, and it would be obvious or evident that some given features of the invention may be used without the use of other disclosed features and this will fall within the scope of the invention as described. It should be understood that such modifications, changes, and substitutions are within the reach of those skilled in the art and are covered by the spirit of the invention. Consequently, every modification, change, or substitution is included within the scope of the invention as defined by the following claims:

We claim the following:

1. An ice-cube making device in a refrigerated cabinet comprising a freezer having a freezer door with a liner to which said ice-cube making device is attached, said ice-cube making device comprising:

a) a case including a side opening for receiving a magazine including at least one ice-cube tray;

b) a venting arrangement to allow cold air to flow through the case;

c) a rack attached to the liner for supporting the case;

d) an ice-extraction mechanism for extracting ice from the ice cube tray by applying a twisting torque to the ice cube tray;

e) at least one ramp configured to direct ice cubes extracted from the ice cube tray towards an ice-cube passageway; and f) an ice cube drawer for receiving the ice cubes extracted from the ice cube tray.

2. The ice-cube making device of claim 1, wherein said ice-extraction mechanism comprises a knob for applying the torque to the ice cube tray, a tubular-receiving projection constructed in an inner face of said knob, at least one slot constructed in a first side wall of the magazine, a first limit pin positioned near a first corner of said ice tray, said limit pin being received in said tubular-receiving projection for travel along the slot in said first wall in response to the applied torque at least till said limit pin reaches an end of said slot, upon reaching the slot end said torque causing twisting of the ice-cube tray about said first corner.

3. The ice-cube making device of claim 2 wherein said ice-extraction mechanism further comprises at least one slot constructed in a second side wall of the magazine opposite the slot in said first wall, a second limit pin positioned near a second corner of said ice tray, wherein said first and second corners comprise diagonally opposite corners of the ice-cube tray, said limit pin being received for travel along the slot in said second wall in response to the applied torque at least till said limit pin reaches an end of said slot, upon reaching the slot end, said torque causing twisting of the ice-cube tray about said second corner, said twisting about said first and second corners of the tray causing one or more ice-cubes to be dislodged from the tray and to pass into the ice cube drawer.

4. The ice-cube making device of claim 1 wherein said venting arrangement comprises at least one vent in said case for receiving a flow of cold air from an air chamber in the refrigerated cabinet, said flow of cold air passing over the at least one ice cube tray in the case, and following a generally downwards path until said flow of cold air reaches the ice cube drawer, said drawer including at least one outlet vent that enables the flow of cold air to exit the ice cube drawer.

5. The ice-cube making device of claim 2, further comprising a mechanism for pivotally supporting said ice-cube tray to the magazine.

6. The ice-cube making device of claim 5, wherein said mechanism for pivotally supporting said ice-cube tray comprises at least one knob cavity for receiving the knob for applying the twisting torque, said knob including a tubular-receiving projection positioned along a central axis of the tray, said ice-cube tray including a first centrally positioned pin passing through an opening in a first side wall of the magazine to be received by said tubular-receiving projection, at least one cutout constructed in a second side wall of the magazine opposite said first side wall, said cutout including a pin-receiving end positioned opposite to the opening on the first side wall of the magazine, said ice-cube tray including a second centrally positioned pin opposite said first pin to be received through said cutout for insertion into the pin-receiving end of said cutout, said centrally positioned pins enabling pivotal movement of the tray along said central axis in response to the applied torque, said pivotal movement being limited by a first and second limit pins in the tray.

7. The ice-cube making device of claim 1, wherein said case, rack, and ice-cube tray may each comprise a thermoplastic material.

8. The ice-cube making device of claim 1, wherein the ice-cube tray includes subdivisions to form the ice cubes, the shape of said subdivisions selected from the group consisting of square, rectangular, rhomboidal, irregular, and any combination of the foregoing shapes.

9. The ice-cube making device of claim 1, wherein said ice cube drawer is removable.

10. The ice-cube making device of claim 1, wherein the ice cube drawer includes a bottom lock for restraining said drawer to the rack.

11. The ice-cube making device of claim 1 wherein said freezer further comprises a plurality of multipurpose trays attached to the liner.

12. The ice-cube making device of claim 1, wherein the freezer liner of the refrigerated cabinet includes at a lower section thereof at least one guiding slot for mounting the rack onto said liner.

13. The ice-cube making device of claim 11, wherein the freezer liner of the refrigerated cabinet further includes at an upper section thereof and at least one lateral section thereof, a respective plurality of protuberances for attaching the rack to said liner.

14. The ice-cube making device of claim 12, wherein the rack comprises a plurality of tabs positioned to engage the protuberances in the liner and thereby attach said rack to the liner.

15. The ice-cube making device of claim 1, wherein the walls of the rack include a plurality of guides for attaching the case to the rack.

16. The ice-cube making device of claim 1, wherein said rack includes a lock for preventing axial movement of the rack with respect to the liner.

17. The ice-cube making device of claim 15 wherein said lock is housed in a recess in said rack, said liner including a protuberance configured to be received for affixing engagement in said recess.

18. The ice-cube making device of claim 1, wherein the rack includes at least one opening in a back wall thereof for receiving an affixing element and secure the rack to the liner during a repair.

19. The ice-cube making device of claim 1, wherein the rack includes a top rail to permit slidable movement of the magazine relative to the rack when said magazine is being introduced or removed from the case.

20. The ice-cube making device of claim 18, wherein the top rail comprises a tapering structure, wherein a wider section of the top rail is proximate to the side opening for receiving the magazine into the rack.

21. The ice-cube making device of claim 19, wherein the top rail includes a plurality of air inlet vents.

22. The ice-cube making device of claim 18, wherein the magazine includes an upper skid for slidable engagement with the top rail of the rack.

23. The ice-cube making device of claim 1, wherein the rack further includes a lower slider and the magazine includes a lower skid comprising a plurality of support bumps to reduce a contact area with said lower slider, and therefore reduce a magnitude of a force for causing the magazine to slide over the lower slider.

24. The ice-cube making device of claim 1, wherein the rack further comprises a plurality of engagement tabs arranged along at least one of the vertical edges of said rack, said tabs configured to engage corresponding guides in the case, said tabs respectively extending to a height sufficient to remove the case from the rack in a range not exceeding approximately half the height of the case.

25. The ice-cube making device of claim 1, wherein the case includes a plurality of C-shaped guides for engagement with corresponding engagement tabs in the rack, and facilitate slidable movement of the case relative to the rack up to approximately half of the total height of the case.

26. An ice-cube making device in a refrigerated cabinet comprising a freezer having a freezer door with a liner to which said ice-cube making device is attachable, said ice-cube making device comprising:

a) a case including a side opening for receiving a magazine including at least one ice-cube tray;

c) a rack attached to the liner for supporting the case;

d) an ice-extraction mechanism for extracting ice cubes from the ice cube tray by applying a torque to the ice cube tray;

e) an electric motor connected to a gear mechanism for applying the torque to the ice cube tray in response to an ice-extraction command signal received by the motor; and f) an ice cube drawer for receiving the ice cubes from the ice tray.

27. The ice-cube making device of claim 26, further comprising a controller configured to generate said ice-extraction command signal.

28. The ice-cube making device of claim 27, further comprising a water valve controlled by the controller in response to a water-filling command signal, and at least one hose connected to the water valve to selectively supply water to the ice-cube tray when the water valve is actuated in response to the water-filling command signal.

29. The ice-cube making device of claim 28 further comprising a water level sensor connected to the controller to provide a signal indicative of a water level in the ice cube tray, a sensor connected to the controller to provide a signal indicative of ice-cube content in the ice-cube drawer, the controller configured to process the signal from the water level sensor and the signal from the ice-cube drawer sensor to generate the ice-extraction command signal and the water-filling command signal at appropriate time intervals so as to automatedly meet respective needs that may arise regarding water-filling and ice-extraction in the ice-cube making device.

* * * * *